United States Patent [19]

Ahlf et al.

[11] Patent Number: 4,538,322

[45] Date of Patent: Sep. 3, 1985

[54] ATTACHMENT NOZZLE FOR A VACUUM CLEANING SYSTEM

[75] Inventors: Heinz-Jürgen Ahlf, Bergisch Gladbach; Wieland Gühne, Remscheid; Peter Wulf, Ennepetal; Hans-Peter Simm, Wuppertal, all of Fed. Rep. of Germany

[73] Assignee: Vorwerk & Co. Interholding GmbH, Wuppertal, Fed. Rep. of Germany

[21] Appl. No.: 617,730

[22] Filed: Jun. 6, 1984

[30] Foreign Application Priority Data

Feb. 23, 1984 [DE] Fed. Rep. of Germany ... 8405468[U]

[51] Int. Cl.[3] ..... A47L 9/04

[52] U.S. Cl. ..... 15/387; 15/180

[58] Field of Search ..... 15/387, 29, 180

[56] References Cited

U.S. PATENT DOCUMENTS 2,678,457 5/1954 Demo et al. ..... 15/29

3,849,823 11/1974 Adamson et al. ..... 15/387 X 3,909,875 10/1975 Rother et al. ..... 15/387

FOREIGN PATENT DOCUMENTS 906814 9/1962 United Kingdom ..... 15/387

*Primary Examiner*—Chris K. Moore

*Attorney, Agent, or Firm*—Walter Ottesen

[57] ABSTRACT

The invention is directed to an attachment nozzle for a vacuum cleaning system such as a vacuum cleaner or the like which includes a rotating brush. A modular step-up gear transmission is interposed between the brush and the air turbine which runs in the suction air stream. The attachment nozzle includes an outer ring region wherein a plurality of air-inlet apertures are formed which are covered either partially or entirely by means of a ring-shaped body which is rotatably mounted on the end portion of the housing. A cup-shaped recess is formed centrally of the plurality of air inlet openings and defines a cup-shaped recess for receiving the modular gear transmission therein.

7 Claims, 2 Drawing Figures

ATTACHMENT NOZZLE FOR A VACUUM CLEANING SYSTEM

FIELD OF THE INVENTION

The invention relates to an attachment nozzle with a rotating brush for a vacuum cleaning system such as a portable vacuum cleaner, built-in vacuum cleaning arrangement or the like. The brush is driven by an air turbine which runs in the stream of suction air of the vacuum cleaning system and a step-up gear is interposed between the brush and the air turbine.

BACKGROUND OF THE INVENTION

Attachment nozzles equipped with rotating brushes which are driven by air turbines are generally known. If the attachment nozzle is intended to perform a more substantial task wherein a larger torque is required, a transmission is arranged between the air turbine and the rotating brush as disclosed, for example, in U.S. Pat. No. 2,609,555.

The air turbine in these attachment nozzles is located in a separate compartment. The air turbine projects with its shaft into a second compartment wherein the gear wheel is located which is connected with the shaft of the rotating brush and which engages a pinion on the shaft of the air turbine.

Configurations of this type have very large dimensions. Because of the separation of the individual gear pieces, only a costly housing structure is possible.

SUMMARY OF THE INVENTION

It is an object of the invention to provide an attachment nozzle for a vacuum cleaning system which makes possible an arrangement of the air turbine, gear transmission and rotating brush in the smallest space and which makes possible a change in the rotational speed by changing the air stream.

The attachment nozzle of the invention which achieves the above object includes a housing attachable to a vacuum cleaning system. The housing has a front end portion wherein a brush is rotatably mounted and annular air inlet means admits and adjusts the flow of a stream of suction air into the housing. The annular air inlet means is at a peripheral region of the housing. An air turbine is rotatably mounted in the housing in the path of the stream of suction air and is rotatably driven thereby. A separate encapsulated step-up gear means is interposed between and operatively connects the air turbine to the brush. A fixed wall structure is mounted in the housing centrally of the air inlet means and defines cup-shaped recess means for receiving the step-up gear means therein. The cup-shaped recess faces into the interior of the housing and away from the brush.

In this way, the invention affords the decisive advantage that an attachment nozzle with a rotating brush is provided wherein the air turbine and the step-up gear means are accommodated in the smallest of spaces.

According to another feature of the invention, the air inlet means includes a plurality of aperture means arranged along a ring and formed in the front end portion of the housing so as to be in surrounding relationship to the brush. A ring-shaped member is rotatably mounted on the front end portion of the housing in covering relationship to the aperture means and has a plurality of openings formed therein so as to be arranged along a ring coincident with said first-mentioned ring; and, said ring-shaped member being rotatable from a first position whereat said openings are displaced from said aperture means so as to cause said aperture means to be completely covered by said ring-shaped member thereby interrupting said air stream to any desired second position whereat said plurality of openings partially or entirely overlap respective ones of said plurality of aperture means thereby adjusting the flow of the air stream to, in turn, adjust the speed of the air turbine.

Thus, the attachment nozzle of the invention also provides the advantage that the rotational speed of the rotating brush can be adjusted by changing the constant air flow.

It is a further advantage of the invention that the special configuration of the recess means for accommodating the gear means and the air turbine provide a good sealing of the gear means with respect to dust.

BRIEF DESCRIPTION OF THE DRAWING

The invention will now be described with reference to the drawing wherein.

DESCRIPTION OF THE PREFERRED EMBODIMENTS OF THE INVENTION

Figure 1:
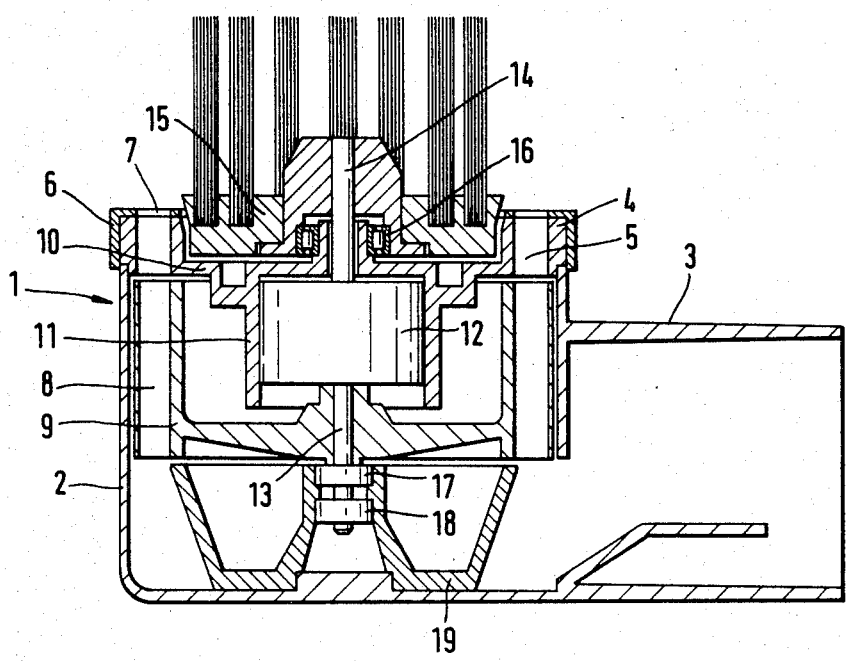
FIG. 1 is a side elevation view, partially in section, showing the attachment nozzle according to the invention; and, FIG. 2 is a plan view of the attachment nozzle looking at the side thereof whereat the rotating brush is located.

In FIG. 1, reference numeral 1 designates the attachment nozzle for a vacuum cleaning system (not shown) such as a vacuum cleaner, for example. This attachment nozzle 1 has a main housing 2 which includes a connecting stub 3 for attachment to an extension of the vacuum cleaner such as a suction hose. The main housing 2 has a ring region 4 wherein a plurality of aperture means in the form of a plurality of air inlet openings 5 are provided. This ring region 4 is covered by a ring-shaped member which is rotatably mounted on the front end of the housing and likewise includes a plurality of openings 7. The openings 7 are in alignment with the air inlet openings 5 of the ring region 4 so that the air inlet openings 5 are completely or partially closed when the ring-shaped member 6 is rotated. In this way, more or less air is directed to the vanes 8 of the air turbine 9 which can then rotate faster or slower.

A fixed wall structure 10 is arranged at the center of the ring region 4. The wall structure 10 includes a cylindrical wall defining a cup-shaped recess 11 at its center which is directed toward the interior of the housing. A completely encapsulated step-up gear transmission 12 is pressed into the cup-shaped recess 11 and held in place therein. The step-up gear transmission 12 is a modular unit and can be configured in any desired manner; however, the drive shaft 13 and the power output shaft 14 must be in alignment with each other. With this configuration, the step-up gear means 12 can be easily exchanged. The power output shaft 14 extends through the wall structure 10 and carries the brush 15. The shaft 14 is supported in the wall structure 10 via a roller bearing 16. The drive shaft 13 is journalled in an insert piece 19 by means of bearings 17, 18. The shaft 13 carries the air turbine 9.

The air turbine 9 has a cup-like shape and surrounds the cup-like recess 11 for receiving the gear means 12 therein so that a labyrinth-like configuration is formed which prevents a rapid dirtying of the step-up gear means 12 and of the drive axis 13. The insert piece 19 carries not only the bearings 17, 18, however, it also at the same time conjointly defines with main housing 2, an air conducting channel for the air flowing away from the air turbine.

Figure 2:
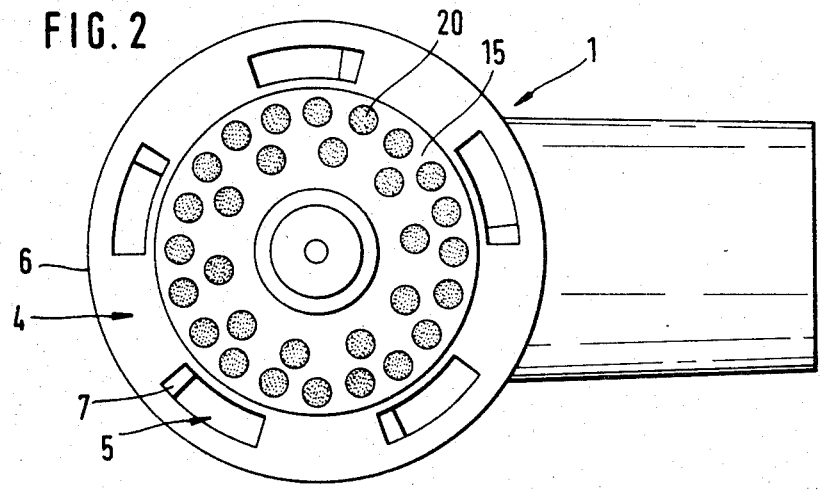

FIG. 2 is a plan view of the attachment nozzle 1. The brush 15 is shown with its bristles 20. The ring region 4 is also shown wherein the air inlet openings 5 are formed. The ring-shaped member 6 covers the ring portion 4 and covers the air inlet openings 5 entirely or partially with its openings 7.

It is understood that the foregoing description is that of the preferred embodiments of the invention and that various changes and modifications may be made thereto without departing from the spirit and scope of the invention as defined in the appended claims.

What is claimed is

1. An attachment nozzle for a vacuum cleaning system such as a portable vacuum cleaner, built-in vacuum cleaning arrangement or the like, the attachment nozzle comprising:

a housing attachable to the vacuum cleaning system, said housing having a front end portion;

a brush rotatably mounted in said front end portion of said housing;

annular air inlet means for admitting and adjusting the flow of a stream of suction air into said housing, said air inlet means being arranged at an outer peripheral region of said housing;

an air turbine rotatably mounted in said housing in the path of said stream of suction air so that said air turbine is rotatably driven thereby;

separate encapsulated gear means for operatively connecting said air turbine to said brush; and, a fixed wall structure mounted in said housing centrally of said annular air inlet means and defining cup-shaped recess means for removably receiving said gear means therein, said cup-shaped recess means facing into the interior of said housing and away from said brush.

2. The attachment nozzle of claim 1, said annular air inlet means comprising:

a plurality of aperture means for admitting the stream of suction air into said housing, said plurality of aperture means being arranged along a ring and formed in said front end portion of said housing so as to be in surrounding relationship to said brush;

a ring-shaped member rotatably mounted on said front end portion in covering relationship to said aperture means and having a plurality of openings formed therein so as to be arranged along a ring coincident with said first-mentioned ring; and, said ring-shaped member being rotatable from a first position whereat said openings are displaced from said aperture means so as to cause said aperture means to be completely covered by said ring-shaped member thereby interrupting said air stream to any desired second position whereat said plurality of openings partially or entirely overlap respective ones of said plurality of aperture means thereby adjusting the flow of said air stream to, in turn, adjust the speed of said air turbine.

3. The attachment nozzle of claim 2, said air turbine having a drive shaft connected to one end of said gear means; and, said gear means being step-up gear means having a power output shaft extending through said wall structure at the base of said recess means for driving said brush.

4. The attachment nozzle of claim 3, said cup-shaped recess means including a cylindrical wall extending away from said wall structure and toward said air turbine; said air turbine being a cup-shaped body having a plurality of vanes at the outer surface thereof, said cup-shaped body being mounted in said housing so as to face and axially overlap said cylindrical wall in telescopic fashion to conjointly define therewith a labyrinth-like configuration thereby hindering the accumulation of dust particles from the air stream from reaching said gear means and said drive shaft of said air turbine.

5. An attachment nozzle for a vacuum cleaning system such as a portable vacuum cleaner, built-in vacuum cleaning arrangement or the like, the attachment nozzle comprising:

a housing attachable to the vacuum cleaning system, said housing having a front end portion;

a brush rotatably mounted in said front end portion of said housing;

air inlet means for admitting a stream of suction air into said housing, said air inlet means being disposed at the periphery of said front end portion so as to be in surrounding relationship to said brush;

an air turbine rotatably mounted in said housing in the path of said stream of suction air so that said air turbine is rotatably driven thereby;

modular gear means for operatively connecting said air turbine to said brush; and, a rigid wall structure mounted centrally in said housing and axially to the rear of said brush, said wall structure having a cylindrical wall thereon defining cup-shaped recess means for receiving said modular gear means therein, said cup-shaped recess means facing into the interior of said housing and toward said air turbine and away from said brush;

said air turbine being a cup-shaped body having a plurality of vanes at the outer surface thereof, said cup-shaped body being mounted in said housing so as to face and axially overlap said cup-shaped recess means in telescopic fashion to conjointly define therewith a labyrinth-like configuration thereby hindering the accumulation of dust particles from the air stream from reaching said gear means and said drive shaft of said air turbine while at the same time defining an axially compact arrangement within said housing of said air turbine and said cup-shaped recess means with said modular gear means seated therein.

6. The attachment nozzle of claim 5, said air inlet means comprising:

a plurality of aperture means for admitting the stream of suction air into said housing, said plurality of aperture means being arranged along a ring and formed in said front end portion of said housing so as to be in surrounding relationship to said brush;

a ring-shaped member rotatably mounted on said front end portion in covering relationship to said aperture means and having a plurality of openings formed therein so as to be arranged along a ring coincident with said first-mentioned ring; and, said ring-shaped member being rotatable from a first position whereat said openings are displaced from said aperture means so as to cause said aperture means to be completely covered by said ring-shaped member thereby interrupting said air stream to any desired second position whereat said plurality of openings partially or entirely overlap respective ones of said plurality of aperture means thereby adjusting the flow of said air stream to, in turn, adjust the speed of said air turbine.

7. The attachment nozzle of claim 6, said air turbine having a drive shaft connected to one end of said modular gear means; and, said modular gear means having a power output shaft extending through said wall structure at the base of said recess means for driving said brush.

* * * * *